United States Patent [19]

Janzon

[11] 4,046,598

[45] Sept. 6, 1977

[54] PROCEDURE FOR MANUFACTURE OF STEEL BAND OR STRIP

[75] Inventor: Bo Lennart Janzon, Storfors, Sweden

[73] Assignee: Uddehoms Aktiebolag, Uddeholm, Hagfors, Sweden

[21] Appl. No.: 651,474

[22] Filed: Jan. 22, 1976

[30] Foreign Application Priority Data

Jan. 22, 1975 Sweden ..... 75006536

[51] Int. Cl.[2] ..... C21D 7/14

[52] U.S. Cl. ..... 148/12 R; 148/12.4

[58] Field of Search ..... 148/12 R, 12.3, 12.4

[56] References Cited

U.S. PATENT DOCUMENTS

| | | | |
|---|---|---|---|
| 3,660,174 | 5/1972 | Jakenberg | 148/12 R |
| 3,755,004 | 8/1973 | Miller | 148/12.4 |

*Primary Examiner*—W. Stallard

*Attorney, Agent, or Firm*—Cushman, Darby & Cushman

[57] ABSTRACT

A process for manufacture of a steel band or steel strip, the steel comprising spheroidal carbide particles in a ferritic base, wherein a steel, the major part of which is a carbonaceous ferritic austenite conversion product which is, structurally, at least one of lamellar perlite, granular perlite, sorbite, bainite and martensite, and which is at a temperature below the steel $A_{cr}$-temperature is heated to a temperature which is above the $A_{cr}$-temperature and within the ferrite metastability range, the steel is then rolled at a temperature in the said metastable temperature range, and the steel is then cooled to below the $A_{cr}$-temperature, the heating, rolling and cooling taking place in a time short enough to ensure that no substantial conversion to austenite occurs in the steel.

6 Claims, 1 Drawing Figure

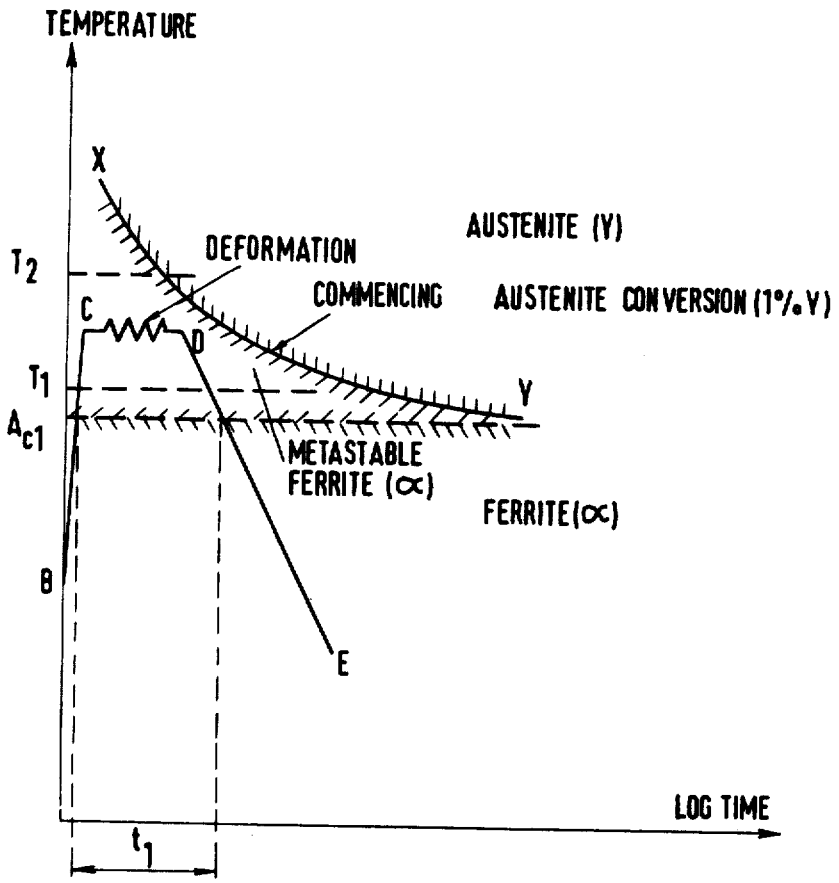
TEMPERATURE
X
AUSTENITE (Y)
DEFORMATION
COMMENCING
AUSTENITE CONVERSION (1% Y)
T2
C
D
T1
Y
Ac1
METASTABLE
FERRITE (α)
FERRITE (α)
B
E
LOG TIME
t1

PROCEDURE FOR MANUFACTURE OF STEEL BAND OR STRIP

The present invention relates to the manufacture of steel band or strip where the steel comprises spheroidal carbide particles in a ferritic matrix using, as starting material, a steel which is structurally, for the most part, i.e. at least 50% by weight, a carbonaceous ferritic austenite conversion product, which is structurally at least one of lamellar perlite, granular perlite, sorbite, bainite and martensite. The starting steel can also contain residual austenite and other structural components in small quantites.

Swedish Pat. No. 226,911 describes a process for the manufcature of steel band using fine-grained perlite and rolling the steel in the ferratic state at a temperatue of 450° to 650° C, preferably 500° to 600° C.

It is also known that favourable product and process characteristics can be obtained by rolling steel band at temperatures up to that at which austenite conversion commences in the steel, the so-called $A_{cl}$ temperature which is, for carbon steel, 720° C and for martensitic stainless chromium steel, 790° C. In this process, it is possible to use a ferritic austenite conversion product, for instance a structure consisting essentially of perlite as described in U.S. Pat. No. 3,660,174 or German Pat. No. 1,927,428, or a structure which, before warming up to rolling temperature consists for the most part of martensite together with residual austenite and possibly a small amount of carbide, as described in Swedish Pat. No. 367,653.

The products obtained by the methods described above, compared with conventional cold rolling products have low resistance to deformation which leads to low rolling strength, good ductility and a negligible deformation hardening which makes possible extensive deformation without distinct recrystallization annealing. In addition, a spheroidal carbide structure is rapidly obtained if the initial material consists largely of lamellar perlite, sorbite, bainite or martensite, retaining respectively a spheroidal structure with a high dispersion rate if the initial material already has such a structure initially. When treatment takes place with a structure that is stable at ambient temperature, as for cold rolling, there is no need for control of the cooling time.

The present invention provides a process for manufacture of a steel band or steel strip, the steel comprising spheroidal carbide particles in a ferritic base, wherein a steel, the major part of which is a carbonaceous ferritic austenite conversion product which is, structurally, at least one of lamellar perlite, granular perlite, sorbite, bainite and martensite, and which is at a temperature below the steel $A_{cl}$-temperature is heated to a temperature which is above the $A_{cl}$-temperature and within the ferrite metastability range, the steel is then rolled at a temperature in the said metastable temperature range, and the steel is then cooled to below the $A_{cl}$ temperature, the heating, rolling and cooling taking place in a time short enough to ensure that no substantial conversion to austenite occurs in the steel.

The basis of the invention is the fact that the incubation time for commencing conversion, even at a temperature of for example 30° C over the $A_{cl}$ temperature and in conjunction with plastic deformation, is sufficient for the requisite warming up and deformation process. In the case of deformation at this temperature, minimal rolling force is utilized together with maximum ductility and hence the possibility of very efficacious deformation. At the same time, there is a very rapid development of spheroidal carbide particles from a carbonaceous, ferrite conversion product of austenite.

The invention will now be described in more detail with reference to the diagram in the accompanying drawing.

The diagram is a graph showing at curve XY the relationship between the temperature for commencing austenite conversion (that is, formation of at least 1% by weight austenite) and the logarithm of time. The curve is not intended to show the quantitative condition of functioning but only to give the fundamental relationship. This is essentially that a specific incubation time is required for the commencement of austenite conversion, and a metastable temperature range for ferrites exists which is between the steel $A_{cl}$-temperature shown on the diagram by the lowest of the horizontal dotted lines and marked $A_{cl}$ and for the curve XY for commencing austenite conversion. In accordance with our invention, the steel is heated to a temperature which is above the $A_{cl}$ temperature and is in the ferritic metastability range and is rolled at a temperature within that range and thereafter cooled to below the $A_{cl}$ temperature sufficiently quickly that the austenite conversion does not commence. The warmingup, deformation and cooling-down sequences are indicated by the line BCDE in the diagram. It is preferred to heat the steel to a temperature 10° to 50° C above the $A_{cl}$-temperature. These temperature limits are indicated by $T_1$ and $T_2$ respectively in the diagram. Warming up, feeding between rollers, rolling and cooling-down should take place sufficiently quickly that austenite conversion does not commence. This means in practice that the total time $t_1$ passing up through the $A_{cl}$-line until the steel temperature after undergoing deformation again passes down through the $A_{cl}$-line, should preferably not exceed 20 seconds and particularly not exceed 10 seconds.

The steel to be subjected to the heating and rolling procedure of the invention is preferably in the form of a steel band 0.5–10 mm thick and particularly 1–5 mm thick.

The following Example is given to illustrate the invention:

EXAMPLE

The starting material is a hot-rolled steel band 2.5 mm thick. The band consists of a carbon steel containing about 1.3% carbon and with a structure consisting predominantly of sorbite. The band is heated quickly from ambient temperature to 750° C in about 5 seconds and is then rolled at the same temperature giving a reduction in cross sectional area of 65% in a single rolling. The rolled band is then cooled down to ambient temperature and reeled up. The total time during which the band remains at a temperature above the $A_{cl}$ temperature is about 8 seconds. Substantially complete spheroidization of carbides occurs in the steel as a result of this treatment and the resulting band has a favourable cross-section on a basis of negligible deformability and complete freedom from defects influencing ductility such as edge interference. After this heating and rolling treatment, the steel band exhibits an unvarying stress limit in comparison with the predominantly sorbitic starting material, while the stretch limits increase considerably. That can be attributed to the fact that carbide spheroidization tends to reduce the stress limit, counteracted by subgrain formation in the ferrite, which also leads to considerable increase in stress limit.

Physical properties of the starting material and of the band rolled in accordance with the invention are shown in the Table below.

| | Stress limit $\sigma_B$ N/mm² | Stress limit $\sigma_{0.2}$ N/mm² | Stress ext. $\delta_{10}$ % |
|---|---|---|---|
| Sorbitic, hot-rolled starting material | 1 390 | 780 | 7.5 |
| Material rolled in accordance with the invention | 1 370 | 1 260 | 7.6 |

We claim:

1. A process for the manufacture of a band or strip of a steel comprising spheroidal carbide particles in a ferritic base which comprises heating a steel, the major part of which is, structurally, at least one carbonaceous ferritic austenite conversion product selected from the group consisting of lamellar perlite, granular perlite, sorbite, bainite and martensite, to a temperature which is above the $A_{cf}$-temperature for that steel and within the ferritie metastability range for that steel, rolling the steel at a temperature in the said metastable temperature range, and then cooling the steel to below the $A_{cf}$-temperature, the heating, rolling and cooling taking place in a time short enough to ensure that no substantial conversion to austenite occurs in the steel.

2. A process according to claim 1, wherein the steel is rolled at a temperature 10° to 50° C above the $A_{cf}$-temperature.

3. A process according to claim 1, wherein the total time the steel remains above the $A_{cf}$-temperature does not exceed 20 seconds.

4. A process according to claim 3, wherein the total time does not exceed 10 seconds.

5. A process according to claim 1, wherein the steel which is heated and rolled is in the form of a band of initial thickness of 0.5–10 mm.

6. A process according to claim 5, wherein the thickness is 1–5 mm.

* * * * *